US005320522A

United States Patent [19]

Vinchon et al.

[11] Patent Number: 5,320,522

[45] Date of Patent: Jun. 14, 1994

[54] GAS BURNER WITH COMBUSTION GRILLE, ITS COMBUSTION PROCESS, AND HEATING INSTALLATION COMPRISING SUCH A BURNER

[75] Inventors: André Vinchon; Thierry Ginioux, both of Paris, France

[73] Assignee: Gaz De France, Paris, France

[21] Appl. No.: 993,234

[22] Filed: Dec. 17, 1992

[30] Foreign Application Priority Data

Dec. 20, 1991 [FR] France ..... 91 15887

[51] Int. Cl.[5] ..... F23D 14/12

[52] U.S. Cl. ..... 431/328; 431/354; 431/347; 431/182; 126/391

[58] Field of Search ..... 431/328, 337, 342, 354, 431/263, 182; 126/391, 392

[56] References Cited

U.S. PATENT DOCUMENTS 3,476,494 11/1969 Buchanan ..... 432/182 X
3,762,390 10/1973 Mendelson ..... 431/328 X
3,772,427 11/1973 Moore .
3,847,565 11/1974 Ford, Jr. .
4,224,019 9/1980 Dilmore .
4,583,938 4/1986 Fardeau .

FOREIGN PATENT DOCUMENTS 269488 6/1988 European Pat. Off. .
103046 7/1895 Fed. Rep. of Germany .
542832 1/1932 Fed. Rep. of Germany .

*Primary Examiner*—Larry Jones
*Attorney, Agent, or Firm*—Pollock, Vande Sande & Priddy

[57] ABSTRACT

Burner fed with combustive air and combustible gas, comprising a distribution chamber (3) communicating with a combustion chamber (11), with interposition between them of a combustion grille (13). The distribution chamber is fed tangentially with air and gas and comprises a mixing turbine (15). The burner may be ignited through the periphery of the combustion chamber.

7 Claims, 3 Drawing Sheets

GAS BURNER WITH COMBUSTION GRILLE, ITS COMBUSTION PROCESS, AND HEATING INSTALLATION COMPRISING SUCH A BURNER

FIELD OF THE INVENTION

The invention relates to a burner with a mixture of gases and with combustion grille(s) usable in particular on immersed tube heating installations, or even on boxes for production of hot air or gas for drying.

BACKGROUND OF THE INVENTION

There exist today, of course, many burners belonging to this category.

However, various practical difficulties remain linked in particular to problems of excessive heating in the flame holding zones, of flame instability and of combustion quality, liable to generate malfunctions and in particular excessive production of carbon monoxide, or even damage to burners.

In particular, in the context of the immersed tube installations designed for the heating of industrial baths, the applicant has already proposed some solutions, one of which is set forth in French Patent Application FR-A-2,606,492 filed on 7 Nov. 1986.

BRIEF DESCRIPTION OF THE INVENTION

With a permanent view to improvement, the applicant now proposes an improved combustion and heating installation, making it possible to improve the conditions for mixing the gases to be burned, to limit the problems of thermal stresses, by ensuring combustion conditions conducive to a good holding of the flames and by limiting, a priori, the emitted quantities of noxious gases (in particular oxides of carbon and of nitrogen).

The solution proposed in the invention consists, in particular, in feeding the distribution chamber of the burner tangentially with air and gas, in which chamber the combustive air and the combustible gas have to be mixed and in disposing in this chamber a turbine prompting this air/gas mixing with an induced effect propitious to a good long-term mechanical strength of the main combustion grille usually interposed between the said distribution chamber and the combustion chamber.

In this manner, it will be possible to ensure a very effective mixing of the air and the combustible gas, conductive to the holding of the flames on the grille, whose resistance to thermal stresses is thus promoted, this leading to effects beneficial to the quality of the combustion and therefore to the limitation of the noxious gases produced.

Advantageously, the mixing turbine will be disposed opposite this main grille, preferably substantially at the level of the zone where the distribution chamber is fed with air and gas via a lateral duct, in such a manner that the blades of the turbine receive the flow of air and gas transversally, permitting them to enter naturally into rotation.

According to another feature of the invention, the distribution chamber will advantageously be surrounded by a peripheral ignition chamber making it possible to ignite the burner through the periphery of its combustion chamber.

As for the means for igniting and for monitoring flames usually necessary on this type of installation, it will be preferred, a priori, to offset them aside from the main grille, in order to mount them through a secondary combustion grille in the form of a frame or ring, interposed between the abovementioned peripheral ignition chamber and the combustion chamber of the burner.

In order to make independent of one another the proportions of air and gas feeding the distribution chamber of the burner and the peripheral ignition chamber, it seemed preferable, moreover, to isolate these two chambers from one another while connecting to each its own pipe for supply of air and gas.

In addition to the burner which has just been presented, the invention also relates to a combustion process of such a burner, this process being characterized essentially in that:

in order to ignite the burner, its peripheral ignition chamber is fed with air and gas, then, while the burner is alight, the supply of combustible gas to the peripheral ignition chamber is interrupted, while maintaining its supply of air.

With such an operating principle, it will of course, here again, be possible to limit the problems of thermal stresses by enveloping the burnt gases with a film of air and by offering an effective solution to the problem of thermal protection of the ignition and flame monitoring means.

The burner of the invention being quite particularly usable on compact immersed tubes designed for the heating of industrial baths, the invention also relates to such a heating installation, characterized in that it comprises a burner of the abovementioned type, the combustion chamber of which is connected to a heat exchanger tube immersed in the bath of liquid to be heated.

In what follows, a more detailed description of the invention will now be given, with reference to the accompanying drawings given solely as non-limitative examples and in which:

DETAILED DESCRIPTION OF THE INVENTION

Figure 1:
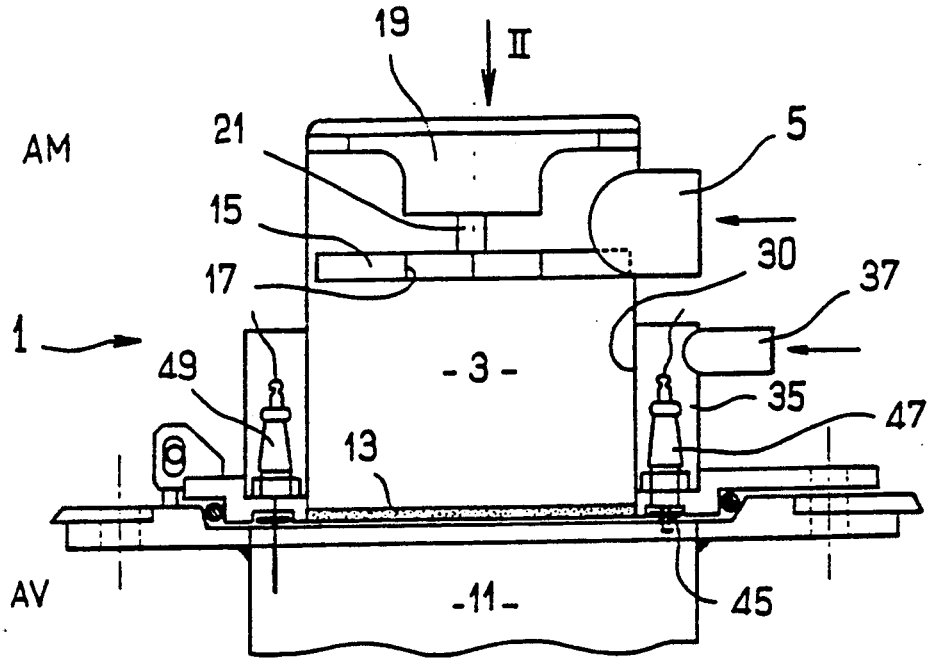
FIG. 1 shows diagrammatically a front view of a burner according to the invention.
Figure 2:
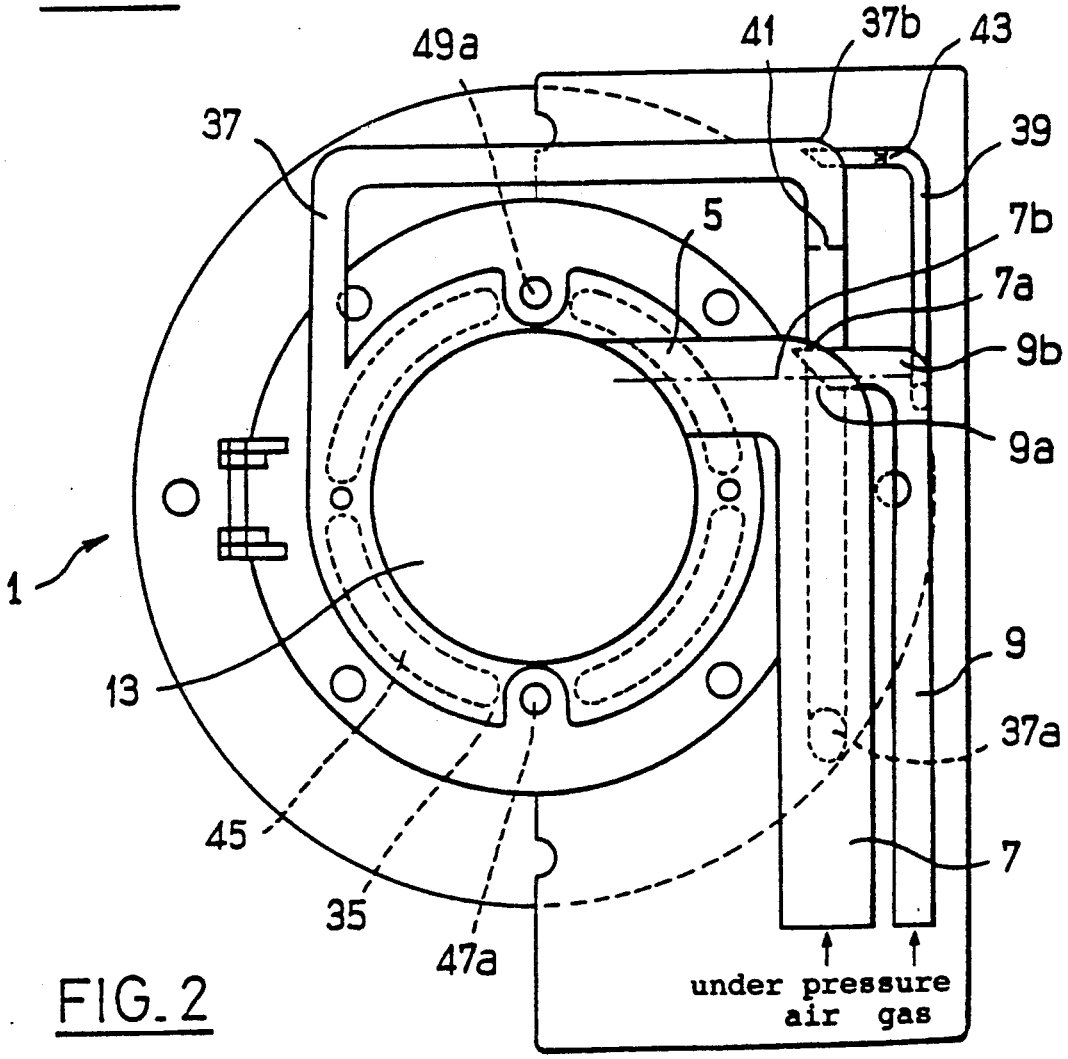
FIG. 2 is a plan view of the burner in the direction of arrow II of FIG. 1, the turbine and its support members having been removed.
Figure 4:
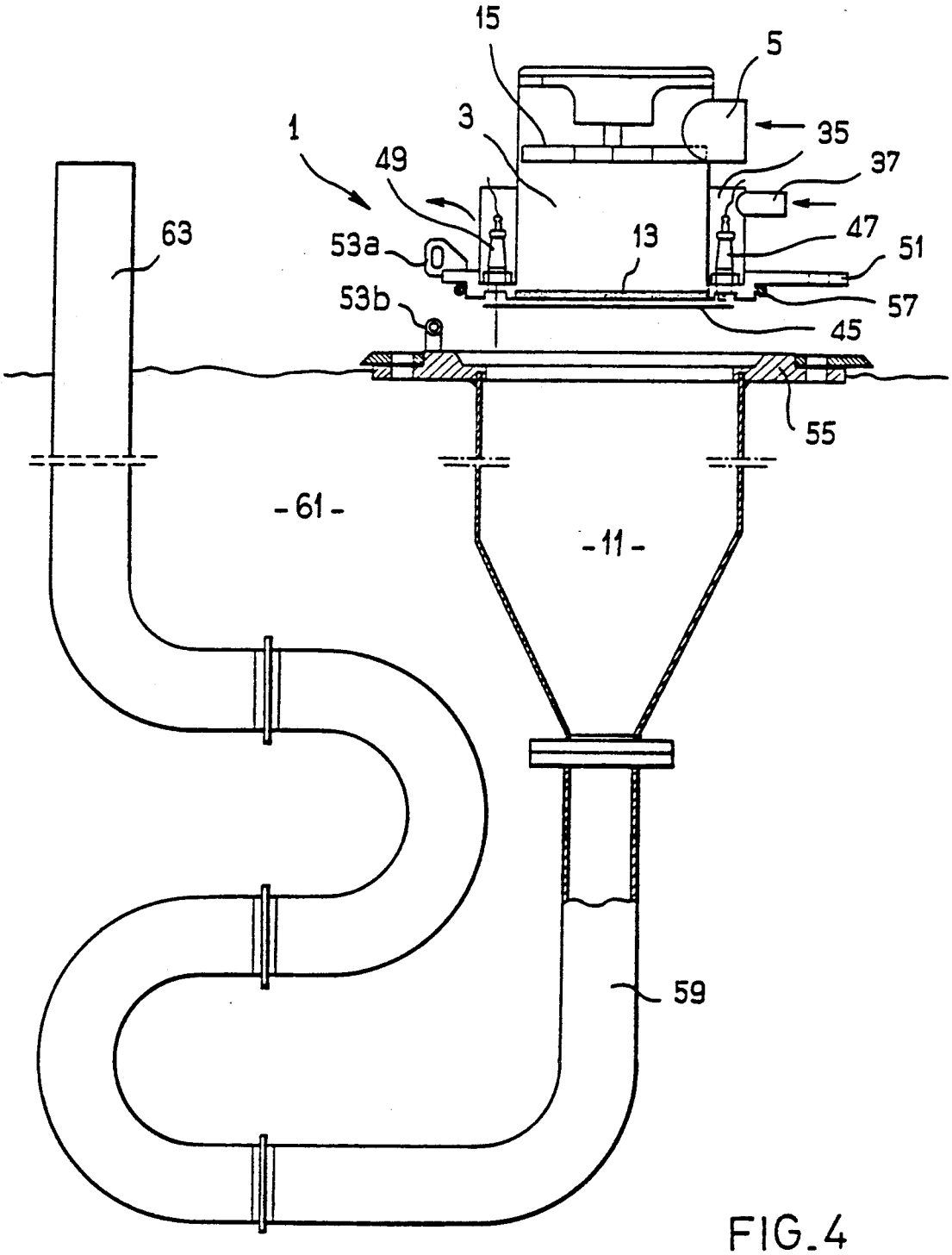
FIG. 4 is a diagrammatic, partially exploded view of the burner of FIG. 1 used on a combustion installation with compact immersed tube.

The abovementioned FIGS. 1, 2 and 4 thus show a gas burner 1 of the general type with premixing and with combustion grille.

In order to ensure an effective mixture of the air and the combustible gas which feeds it, this burner comprises a distribution chamber 3 (sometimes called "premixing" chamber).

This distribution chamber, which may in particular have a cylindrical shape of substantially circular cross-section, is fed tangentially with combustive air and combustible gas under pressure (preferably at least partially mixed already) via an inlet 5.

As is seen more clearly in FIG. 2, the inlet 5 may leave the main air supply duct 7 to which is connected the main duct 9 for supply of combustible gas, at the location of a bend *7a* (preferably the last before the chamber 3).

The connection at *9a* of the duct 9 may be made in particular just after a bend *9b*, so that the combustible gas emerges into the combustive air duct substantially parallel to the axis *7b* of its last rectilinear part forming the pipe, with a bevel-shaped terminal part *9a* in the direction of the flow running.

In order to stabilize the flame front, the distribution chamber 3 is separated from the combustion chamber 11 by a flame-holding grille or combustion grille termed "main" 13, disposed transversally between these two chambers.

In this case, the grille 13 has the shape of a circular disc perpendicular to the cylinder axis of the chamber 3.

The grille may be constructed in particular from materials and structures of the sintered bronze type or of a stack of finely perforated metal sheets, or else of fibrous ceramic or of metal fabric, so as advantageously to present a lacunar structure, porous to the mixture of air and gas which will then circulate through the apertures or passages made through it.

In order to improve the quality of the combustion and to promote the mechanical strength (in the face, in particular, of thermal stresses) of this grille, there is disposed opposite the latter, in the chamber 3, a mixing turbine 15. It has seemed preferable to place this turbine substantially at the level of the zone, opposite the grille, where the lateral inlet 5 is connected tangentially to the chamber 3.

In this manner, the blades 17 of the turbine (which is seen more clearly in FIG. 3), will be capable of receiving the gaseous mixture transversally while forming a partitioning in the chamber.

A boss 19 located, in FIG. 1, towards the top of the chamber 3 supports the rotation shaft 21 of the turbine which can turn therein in a conventional manner, via ball bearings (not shown).

It will be noted that, taking into account the tangential disposition of the inlet 5, the turbine thus disposed will naturally be capable of being set in rotation and will rapidly reach its optimal speed (for example of the order of 10,000 rpm), this without any other driving device, thus ensuring a first homogenization of the mixture, the rotational movement of this turbine creating, in addition, recirculation currents between the upstream part (US) and the downstream part (DS), conferring on this mixture a very good homogeneity when it is blown axially towards the grille 13.

Figure 3:
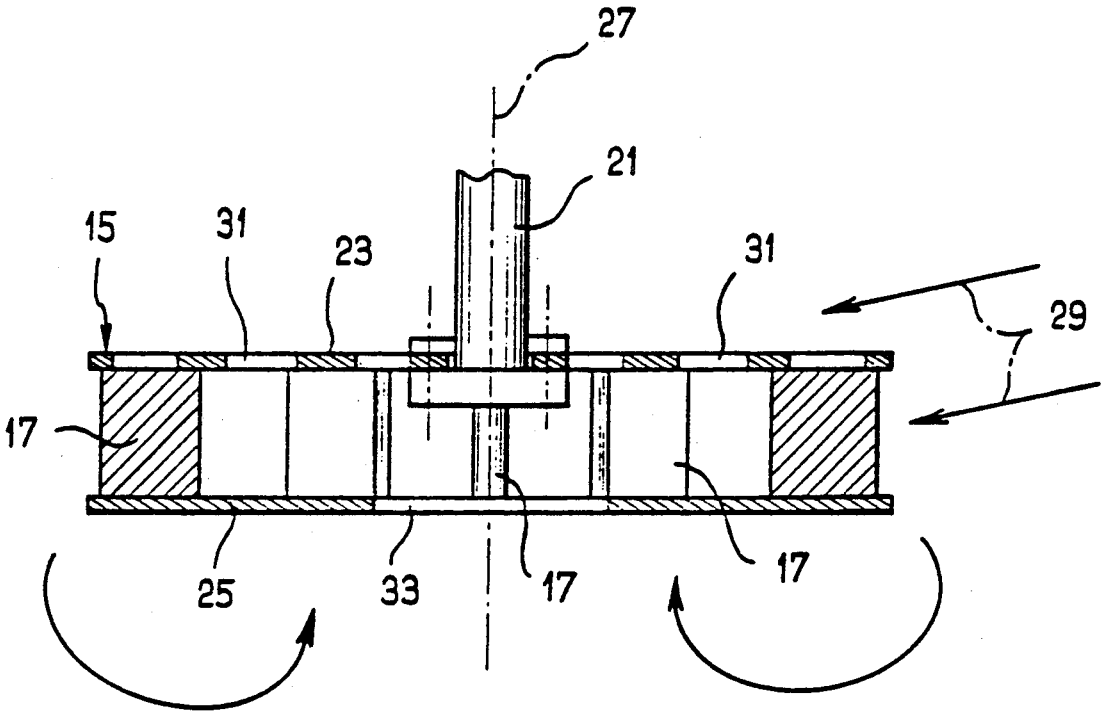
FIG. 3 shows in central cross-section a type of turbine usable in the context of the invention.

FIG. 3 shows in greater detail the active part of a turbine which consists here essentially of two parallel plates 23, 25 extending perpendicularly to the vertical axis of rotation 27 of the drive shaft 21. These two plates, which may have a disc shape, are separated by a series of mixing blades 17, so that these blades transversally receive the flow to be mixed (shown diagrammatically by the arrows 29), either directly, or through distribution apertures 31 made in the upper plate, these apertures, and the large central aperture 33 formed in the lower plate 25, promoting the dynamics of the turbine and the recirculation movements of the flow.

For the ignition of the burner, the invention has retained the solution of a "peripheral" ignition, via an ignition chamber 35 extending all around the distribution chamber 3, a priori essentially in its downstream part (DS) (see FIG. 1).

In order for it to be possible to regulate at will and in an autonomous manner the air and the gas feeding the distribution and ignition chambers respectively, it seemed preferable to isolate them from one another by a separating partition 30 and to provide the ignition chamber 35 with its own inlet of mixture, via a tangential supply pipe 37.

In practice, the pipe 37 may come from a tapping made at *37a* on the main air supply duct 7, of a larger cross-section, the combustible gas possibly being introduced into this pipe by a pipe 39 of further reduced cross-section itself coming from a tapping made on the main combustible gas supply duct 9, this pipe 39 joining the pipe 37 at the location of a penultimate bend *37b*, substantially under the same connection conditions as those cited for the ducts 9 and 7.

In order to ensure the proportioning of the mixture supplied to the ignition chamber 35, provision may be made to interpose a diaphragm 41 in the pipe 37 and an injector 43 in the pipe 39.

And in order to hold the ignition flame, a secondary combustion grille 45 will advantageously be interposed between the ignition chamber and the combustion chamber 11.

The distribution chamber 3 and ignition chamber 35 being preferably disposed concentrically, this secondary grille may, in particular, have the shape of a frame or of a ring surrounding the main grille.

In fact, if the necessary ignition means 47 and flame monitoring means 49 are mounted in the chamber 35 in such a manner that they pass through the grille 45, it will be possible not only to ensure an effective peripheral ignition, but also to improve the monitoring conditions by limiting the thermal stresses sustained by these accessories. For this, it will be sufficient when the ignition sequence of the burner starting cycle has been completed and when the burner has been kept alight by virtue of the detection of the flames, to cut the supply of gas to the chamber 35 while maintaining its supply of air.

The flames hitherto held to the secondary grille 45 will then be extinguished. But the air coming from the pipe 37 will continue to escape through this grille towards the combustion chamber 11, this airflow then constituting an excellent means for continuous cooling of the plug 47 and of the monitoring electrode 49, and also of the flanges 51 and 55.

FIG. 2 shows diagrammatically at *47a* and *49a* the privileged locations of these ignition means and flame monitoring means, the positions of which have intentionally been offset by $\pi/2$ in FIG. 1 so that they can be shown therein.

It will be noted that the disposition of FIG. 2 is advantageous in that it makes it possible first of all to offset the said means 47, 49 aside from the main grille 13, which does not have any device passing through it, and in that it will thus be possible for the gas/air mixture emerging from the pipe 37 and turning in the chamber 35 to encounter first the ignition electrode and then the flame monitoring electrode, with a certain logic of the sequences.

Of course, the secondary grille 45 may have a structure comparable to the main grille 13, that is to say a "porous" structure being for example constituted by the stacking of two perforated rings of sheet metal.

With reference to FIG. 4, two further features may be noted which can expediently complete the equipping of this burner.

a) First of all, the distribution and ignition chambers with their accessories can be borne by a support plate 51 making it possible to mount on the burner additional equipment of the electrovalve, pressostats, ignition transformers, . . . type.

This plate may come to interact in a manner articulated in rotation via additional hinge members 53*a*, 53*b*, with an additional plate or flange 55 to which is secured the combustion chamber 11, towards its inlet.

b) Moreover, an O-ring 57 interposed between the plate 51 and the flange 55, at the location of a conical bevel machined in this flange, may promote the centering of the burner head on the combustion chamber, while reducing the thermal transfers by conduction coming from this chamber, thus ensuring a relative thermal insulation of the walls and accessories of the burner head by the absence of direct contacts between the parts 51 and 55, except at the location of their connecting bolts.

Still in FIG. 4, it may furthermore be noted that the burner is here shown mounted on an immersed tube installation, the combustion chamber 11 being connected at its outlet to a heat exchanger tube 59 (for example of metal) passing or meandering through a bath 61 of liquid to be heated, the combustion products being then discharged to the free air through the outlet 63. The combustion chamber and the tube 59 are both immersed.

We claim:

1. A gas burner comprising:

a fuel gas distribution chamber located in axially communicating relation to a combustion chamber;

means for supplying tangential flows of mixed air and fuel gas to the respective chambers;

grille means positioned between the chambers for allowing passage of gases therethrough and for stabilizing flames across the grill, produced from combustion of the mixture;

igniter means extending into the combustion chamber for igniting the mixture, passing into the combustion chamber, thus producing the flames;

turbine means axially located in the distribution chamber and transversely in-line with the supplying means for receiving the tangential mixture flow and enhancing the mixing of the air and fuel gas in the chambers as well as generating a cooling flow through the grill.

2. The burner set forth in claim 1 wherein the tangential flow supply means comprises:

a first duct extending tangentially from an interior wall of the distribution chamber for conveying air thereto; and a second duct intersecting the first duct for introducing fuel gas into the air conveyed into the distribution chamber.

3. The burner set forth in claim 1 further comprising:

an annular ignition fuel chamber coaxially located around the distribution chamber;

an annular flame stabilizing ring, concentric with the ignition fuel chamber, and separating the ignition and combustion chambers, for allowing mixed air and gas to flow therebetween thereby stabilizing flames produced from the combustion of the mixture;

the igniter means extending through the flame stabilizing ring and shielded from the distribution chamber.

4. The burner set forth in claim 3 further comprising:

a duct tangentially communicating with an outer wall of the annular ignition fuel chamber for introducing a tangential flow of mixed air and fuel gas into the ignition fuel chamber; and flame monitoring means extending through the flame stabilizing ring and angularly offset from the igniter means so that the mixture encounters the igniter means before the monitoring means.

5. The burner set forth in claim 3 wherein the annular ignition fuel and distribution chambers are peripherally separated by a wall so that the flows of mixed fuel gas and air to these chambers are respectively independent from one another.

6. The burner set forth in claim 5 wherein the flame stabilizing grid is manufactured from a material selected from the group consisting of: sintered bronze, perforated sheet metal, ceramic or metal fabrics.

7. A burner comprising:

a fuel gas distribution chamber located in axially communicating relation to a combustion chamber;

means for supplying tangential flows of mixed air and fuel gas to the respective chambers;

grille means positioned between the chambers for allowing passage of gases therethrough and for stabilizing flames across the grill, produced from combustion of the mixture;

igniter means extending into the combustion chamber for igniting the mixture passing into the combustion chamber, thus producing the flames;

turbine means axially located in the distribution chamber and transversely in-line with the supplying means for receiving the tangential mixture flow and enhancing the mixing of the air and fuel gas in the chambers as well as generating a cooling flow through the grill; and a heat exchanger tube connected to an exhaust end of the combustion chamber which is immersed, along with a section of the combustion chamber, in a liquid to be heated.

* * * * *